United States Patent [19]

Valdespino

[11] 4,121,512

[45] Oct. 24, 1978

[54] FLUID SYSTEM FOR COMPACTING AND SQUEEZING APPARATUS

[76] Inventor: Joseph M. Valdespino, 5023 Golf Club Pkwy., Orlando, Fla. 32808

[21] Appl. No.: 805,895

[22] Filed: Jun. 13, 1977

[51] Int. Cl.[2] ..... B30B 15/22

[52] U.S. Cl. ..... 100/52; 100/116; 100/269 R; 91/47; 91/454

[58] Field of Search ..... 91/454, 47; 100/50, 100/DIG. 2, 52, 104, 110, 116, 130–131, 269 R

[56] References Cited

U.S. PATENT DOCUMENTS

| | | | |
|---|---|---|---|
| 1,103,037 | 7/1914 | Clark | 100/269 R X |
| 1,939,556 | 12/1933 | Kammer | 100/130 X |
| 3,024,720 | 3/1962 | Welsh | 100/269 R X |

*Primary Examiner*—Robert L. Bleutge

*Attorney, Agent, or Firm*—Duckworth, Hobby, Allen & Pellis

[57] ABSTRACT

A water cylinder compacting and squeezing apparatus has a control valve requiring a connection of only one tube to the water cylinder for driving and retracting the piston in the cylinder. A water cylinder is mounted to a frame having a removable container and a compacting or squeezing portion connected to a piston rod so that the water cylinder can be connected to the household water supply for squeezing or compacting foods or other materials. A water flow control system includes a first valve for turning on the flow of water which is directed into the water cylinder for driving a piston. A second valve allows the water to flow to the drain and create a suction to draw the water from the cylinder to return the piston. Once the piston is returned, the first valve shuts off the flow of water.

14 Claims, 4 Drawing Figures

FLUID SYSTEM FOR COMPACTING AND SQUEEZING APPARATUS

BACKGROUND OF THE INVENTION

The present invention relates to a system for compacting or squeezing materials with a water actuated cylinder and especially to such a system having a control valve which allows the use of a single line for driving and returning the piston in the water cylinder.

In the past, it has been common to use hydraulic cylinders which drive a piston by the use of hydraulic fluids driven by pumps, or in some cases, driven by air pressure in an air over hydraulic system. Hydraulic fluids are used rather than gasses, such as air, because the fluids are not generally compressible and because of the mechanical advantage gained by the size of the cylinder and piston used. Thus, the pressure per square inch on a fluid remains the same against a piston so that a larger piston area substantially increases the driving force by the number of square inches times the pounds per square inch pressure applied to the piston. A larger sized area reduces the speed with which the piston is driven but the mechanical advantage allows a hydraulic piston to lift large masses with a relatively small hydraulic pump driven system. It has also been suggested to utilize water in a fluid cylinder system in which the water pressure in a household waterline is utilized to lift objects inasmuch as water, being a fluid, can have the same mechanical advantage as a hydraulic cylinder and can capitalize on the pressure in a standard community water supply system.

The present invention utilizes a standard community water supply in driving a cylinder and capitalizes on the mechanical advantages of the cylinder by using a sufficiently large cylinder to compact or squeeze objects. The present water cylinder can also be utilized with a small pump, if desired, and can be used for systems other than for compacting or squeezing materials. The water cylinder, advantagesouly, is driven with a valving system which requires only one water line connection to the cylinder for driving and returning the piston without the use of piston return springs or return water lines.

SUMMARY OF THE INVENTION

A compacting or squeezing apparatus has a water input connected to a source of water under pressure. The water input is connected to a control valve which is, in turn, connected to a cylinder having a piston therein for driving a piston rod extending through the cylinder and having a compacting and squeezing surface attached thereto. The cylinder is mounted to a frame which has a space for placing a container adapted to receive materials to be compacted or squeezed. The water input is attached to a control valve system, which in turn, is connected by a single line to the cylinder, and also has a line to a drain. The control valve system has a venturi therein with a connection for a cylinder placed adjacent the venturi. The main valve for turning on the water is provided and the drain valve is located in the drain portion of the valve system. Thus, with the drain valve closed and the main water valve open, water is forced through the valve and through the line connecting the water cylinder. However, when the drain valve is open, the water is directed through the drain, thereby creating a suction in the cylinder line adjacent the venturi so as to draw water from the water cylinder and thereby raise the piston in the cylinder.

BRIEF DESCRIPTION OF THE DRAWINGS

Other objects, features and advantages of the present invention will be apparent from the written description and the drawings in which:

FIG. 3 is a sectional view of a fluid system in accordance with

FIG. 2, set to return a fluid piston; and

DESCRIPTION OF THE PREFERRED EMBODIMENTS

Figures 1, 4:
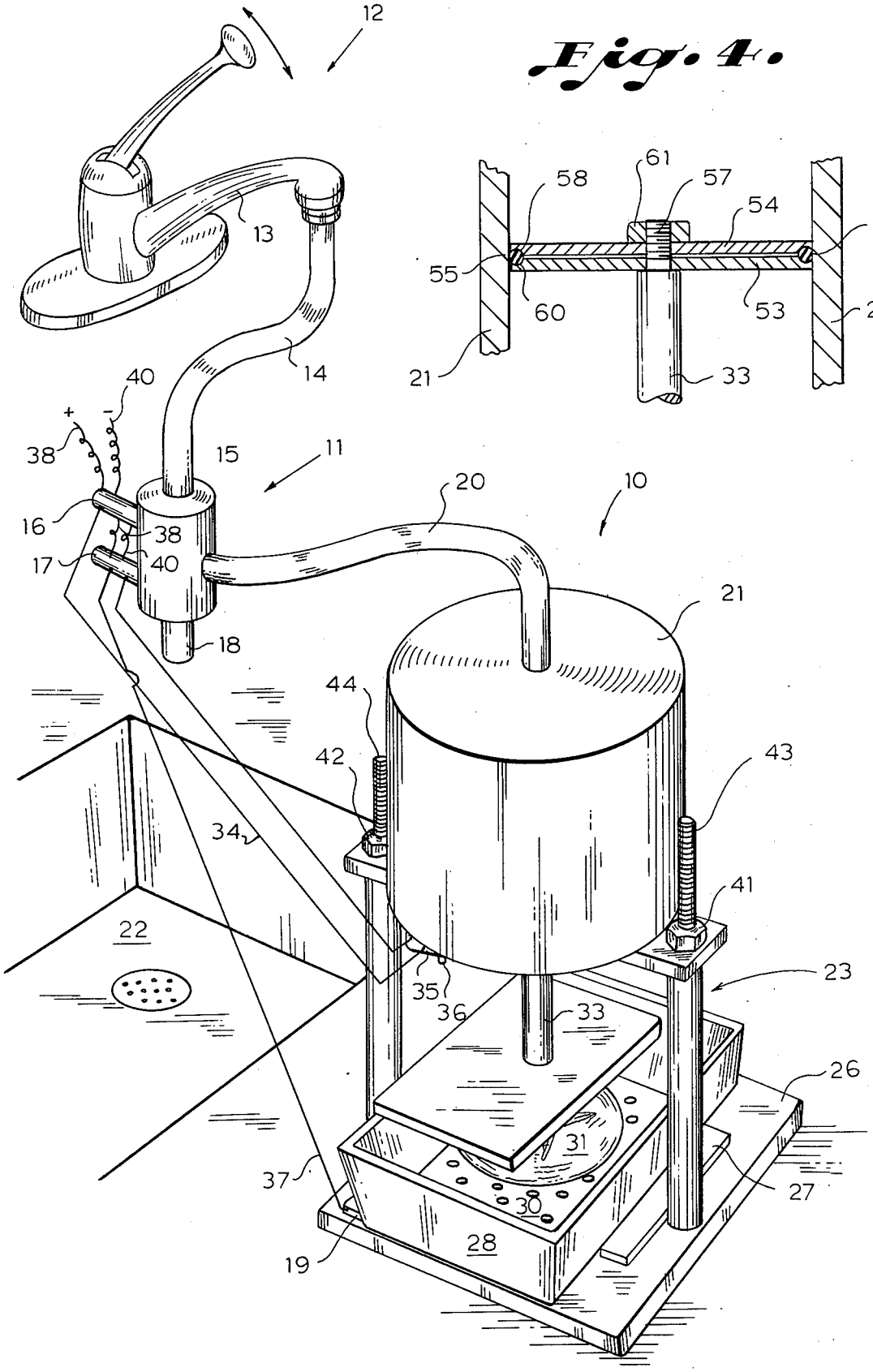
FIG. 1 is a perspective view of a compacting and squeezing apparatus in accordance with the present invention.
FIG. 4 is a sectional view of a piston in accordance with the present invention.

Referring to the drawings and especially to FIG. 1, a water cylinder compacting and squeezing apparatus 10 is connected through a control valve system 11 to a household water supply 12. The water supply 12 may be an ordinary household faucet 13 connected by a hose or pipe 14 to the control valve 11. The pipe 14 supplies water to the control valve 11 which has a casing 15, a main solenoid valve 16 and a drain solenoid valve 17, connected thereto. The control valve 11 has a drain outlet 18 and a pipe 20 connected to the side of the casing 15 and to the water cylinder 21. The output 18 may be directed to an ordinary household drain 22. A fluid cylinder 21 has a piston thereinside and is mounted to a frame 23 which includes a piston support 24 mounted to supporting columns 25 from a base 26. The base 26 may have guides 27 thereon for positioning a receptacle 28. The receptacle 28 illustrated in this embodiment has a false bottom 30 with a plurality of holes therein to act as a strainer and is illustrated with a piece of fruit 31 being squeezed by a compacting surface 32 connected to a piston rod 33. Solenoid 16 is connected by an electrical conductor 34 to a microswitch 35 having an override switch 36 which may act as the master switch. The microswitch 35 is activated by the top of the compacting surface 32 coming into contact therewith to actuate a whisker switch or the like. Solenoid 17 is connected by an electrical conductor 37 to a pressure switch located under the receptacle 28 and is activated by a predetermined pressure being applied against the receptacle. Solenoid 16 and 17 also have electrical conductors 38 and 40 connected thereto for supplying the energy for actuation of the solenoids.

In operation, the solenoid 16 is actuated to allow the input of water under pressure to the input line 14. Solenoid 16 is a solenoid valve which may be actuated by the override switch 36. Water entering the casing 15 of the control valve 11 is directed through the line 20 since the solenoid valve 17 is still shut off. Water entering the water piston 21 drives the piston and piston rod 33 and compacting surface 32 to compact or squeeze the fruit 31 or other material placed therein. When the pressure reaches a predetermined level, a pressure switch connected to a line 37 actuates a solenoid valve 17 opening the valve in a direct passageway to the output 18. The water from the pipe 14 thereby flows directly to the casing 15 and out the drain 18. A venturi located in the casing 15, adjacent the connection of the line 20 therewith produces a suction or aspiration in the line 20 and in the cylinder 21 thereby pulling water from the cylinder 21 out the drain 18, emptying the cylinder and lifting the piston therein. This continues until the compacting surface 32 hits the microswitch 35 shutting off the solenoid valve 16 and 17 until the master switch 36 is actuated for the next squeezing or compacting job.

It should be clear at this point, that the piston 21 can be used for squeezing fruits, such as citrus fruits, for making orange juice, or the like, or in larger versions can be used for compacting trash by the use of a small metal trash receptacle in place of the receptacle 28. The cylinder 21 riding in the support 24 may be adjusted by a pair of nuts 41 and 42 riding on threaded surfaces 43 and 44 connected to the column 25.

Figure 2:
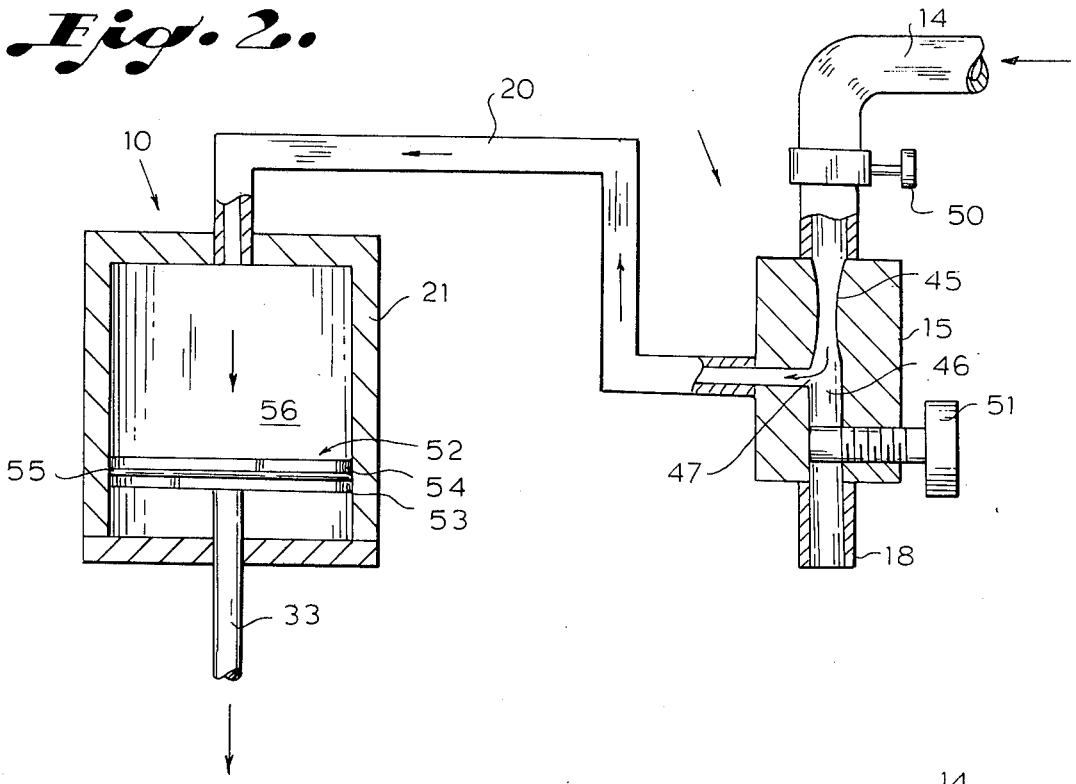
FIG. 2 is a sectional view of a fluid control system set to drive the water piston.

The operation of the control mechanism 11 is more clearly illustrated in connection with FIGS. 2 and 3, in which FIG. 2 has the piston rod 33 being driven for a compacting operation while FIG. 3 has the piston rod 33 in a return stroke. The input pipes 14 can be seen connected to the control mechanism casing 15 which has a venturi 45 therein forming a passageway 46 through the valve casing 15 to the output 18 adjacent one end of the venturi 45 pipe 20 connected through an opening 47 to the passageway 46 adjacent the venturi 45. A valve 50 illustrated as a hand operated valve, in FIGS. 2 and 3, can be opened to allow the inflow of water under pressure in both FIGS. 2 and 3, while hand-actuated valve 51 is closed in FIG. 2 and open in FIG. 3. Thus, in FIG. 2, the fluid entering the passageway 46 is directed to the opening 47 and through the pipe 20 into the interior of the cylinder 21 against the surface of the piston 52, for driving the piston rod 33. The piston 52 includes a bottom plate 53, a removable top plate 54, and an O-ring type sealing ring 55 compressed therebetween. The chamber 56 is filled with a fluid under pressure from the line 20 to drive the piston 52 which has a pressure proportional to the surface area of the piston 52. Thus, a larger piston 52 will generate more pressure, but will move more slowly while a smaller piston 52 will move faster, but will generate less force.

Figure 3:
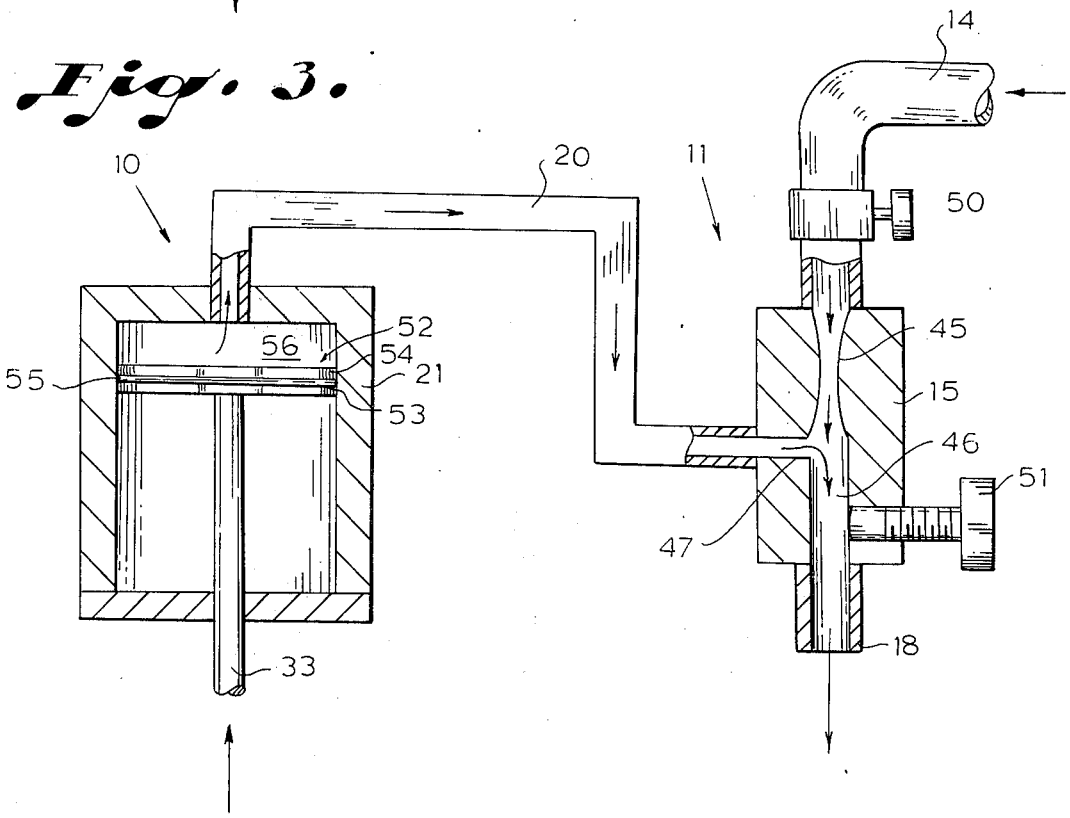

In FIG. 3, the valve 20 has been opened so that the fluid entering the input 14 is directed through the venturi 45 passage way 46 and out the drain 18, thereby generating a suction at the opening 47 and in the line 20 to withdraw the fluid from the chamber 56 and thereby raise the piston 52. This control system 11 has the advantage of requiring only a single connecting line 20 between the controls and the cylinder 10 for raising and lowering the piston 52 and not requiring return stroke springs to return the piston 52.

Referring now to FIG. 4, a sectional view of a piston 52 in the cylinder 21 is more clearly illustrated having a bottom or base plate 53 fixedly attached to the piston rod 32 and having a threaded portion 57 protruding thereabove. The piston top plate 54 has an annular curved end portion 58 while the base plate 53 has an annular curved portion 60. The plate 54 is threadedly attached to the threads 57 and screwed down until contacting the plate 53, thereby forming an arcuate surface between the surfaces 58 and 60. As the plate 54 is tightened down on the threads 57, the O-ring 55 is compressed between plates 53 and 54 to expand the O-ring against the walls of the cylinder 21 to provide a seal between the piston 52 and the cylinder 21. The lock nut 61 may be provided on top of the plate 54 to assure that the plate 54 remains locked in position.

It should be clear at this point that a compacting or squeezing system using a community water supply has been provided, but it should also be clear that fluids other than water might be used in the system and the system might be driven by a small pump rather than the pressure in the community water system. It should also be clear at this point that a control system has been provided which can be manually operated or actuated automatically through electrical solenoid valves or which might be actuated with fluidic switches and valves without departing from the spirit and scope of the invention. Accordingly, the present invention is not to be construed as limited to the particular forms disclosed herein, which are to be regarded as illustrative rather than restrictive.

I claim:

1. A fluid system comprising in combination:

a cylinder;

a piston slidably mounted in said cylinder for driving a piston rod extending through said cylinder;

a control system having: a casing, a fluid input in said casing, a fluid output from said casing, and a first passageway through said casing connecting said input and output, said passageway forming a venturi in said casing and a second passageway in said casing connecting with said first passageway adjacent said venturi formed in said first passageway, said second passageway being operatively connected to said cylinder;

a first valve connected to said fluid input for turning said input on and off; and a second valve connected to said fluid outut for opening and closing said output whereby fluid can be directed through said first passageway into said cylinder for driving said piston when said first valve is open and said second valve is closed and a fluid can be directed through said first passageway to said fluid output when said second valve is open thereby returning said piston in said cylinder.

2. A fluid system in accordance with claim 1, in which said first valve is a solenoid-actuated valve.

3. The apparatus in accordance with claim 2, in which said first solenoid valve is actuated by a hand-operated switch.

4. The apparatus in accordance with claim 2, in which said second valve is a solenoid-actuated valve.

5. The apparatus in accordance with claim 4, in which said first solenoid valve is actuated by a hand-operated switch and by a switch tripped by the movement of said piston rod to a predetermined position.

6. The apparatus in accordance with claim 4, in which said second solenoid valve is operated by a pressure switch actuated by said piston applying pressure to an object.

7. The apparatus in accordance with claim 1, in which said cylinder is mounted to an adjustable frame for positioning the cylinder for driving the piston rod in a predetermined direction.

8. The apparatus in accordance with claim 7, in which said frame has a removable receptacle attached thereto.

9. The apparatus in accordance with claim 8, in which said piston rod has a compacting surface thereon adapted to be directed into said receptacle for compacting material in said receptacle.

10. The apparatus in accordance with claim 1, in which said control system fluid output is operatively coupled to a household drain.

11. The apparatus in accordance with claim 10, in which said removable receptacle has a removable strainer bottom portion therein.

12. A compacting and squeezing mechanism comprising in combination:

a water input connected to a source of water under pressure;

a control system connected to said water input and having an output therefrom, said control system having a valve connected to said water input and having a venturi formed therein, and said control system also having an output valve connected to said output;

a water cylinder having a piston slidably mounted therein and attached to a piston rod extending through said cylinder, said piston rod having a crushing surface attached thereto;

a frame having said cylinder attached thereto and having a space for placing a receptacle adapted to receive materials to be crushed by said crushing surface; and a water connection connecting said control system to said cylinder by connecting to said control system valve adjacent the venturi formed therein, whereby a fluid system can be used to compact materials.

13. The apparatus in accordance with claim 12, in which said frame having said cylinder attached thereto has adjustable members for adjusting the position of said cylinder on said frame.

14. The apparatus in accordance with claim 13, in which said control system has a water input valve for opening and closing the input of water into said control system.

* * * * *